US011332973B2

(12) United States Patent
De Vries et al.

(10) Patent No.: US 11,332,973 B2
(45) **Date of Patent: *May 17, 2022**

(54) SPRING OPERATED ROLLER BLIND SYSTEM WITH END POSITION ADJUSTING MECHANISM

(71) Applicant: COULISSE B.V., Enter (NL)

(72) Inventors: Ruben Hubert Jan De Vries, Zevenaar (NL); Bastiaan Franciscus Klein Tuente, Groenlo (NL); Thomas Johan Maria Ter Haar, Hengelo (NL)

(73) Assignee: Coulisse B.V., Enter (NL)

( * ) Notice: Subject to any disclaimer, the term of this patent is extended or adjusted under 35 U.S.C. 154(b) by 420 days.

This patent is subject to a terminal disclaimer.

(21) Appl. No.: 15/733,003

(22) PCT Filed: Jun. 7, 2017

(86) PCT No.: PCT/NL2017/050373
§ 371 (c)(1),
(2) Date: Dec. 3, 2018

(87) PCT Pub. No.: WO2017/213499
PCT Pub. Date: Dec. 14, 2017

(65) Prior Publication Data

US 2019/0162021 A1 May 30, 2019

(30) Foreign Application Priority Data

Jun. 7, 2016 (NL) ..... 2016905

(51) Int. Cl.
*E06B 9/42* (2006.01)
*E06B 9/88* (2006.01)
(Continued)

(52) U.S. Cl.
CPC ..... *E06B 9/42* (2013.01); *E06B 9/50* (2013.01); *E06B 9/60* (2013.01); *E06B 9/88* (2013.01); *E06B 2009/402* (2013.01)

(58) Field of Classification Search
CPC ..... E06B 9/80; E06B 9/42; E06B 9/88; E06B 9/50; E06B 9/60; E06B 2009/402
See application file for complete search history.

(56) References Cited

U.S. PATENT DOCUMENTS 6,467,714 B1 * 10/2002 Rasmussen ..... E06B 9/44 242/381
8,556,204 B2 * 10/2013 Kao ..... E06B 9/80 242/422.2

(Continued)

FOREIGN PATENT DOCUMENTS

DE 20116309 U1 1/2002
EP 0210381 A2 2/1987

(Continued)

OTHER PUBLICATIONS

International Search Report in International application PCT/NL2017/050373, dated Sep. 20, 2017.

*Primary Examiner* — Daniel P Cahn
(74) *Attorney, Agent, or Firm* — Oppedahl Patent Law Firm LLC

(57) ABSTRACT

The invention relates to a spring operated roller blind system, wherein the roller blind (1) comprises an adjusting mechanism (30) for adjusting an end position of the flexible sheet member. The adjusting mechanism comprises a spindle (36) and a connecting member (31) that is connected to the roller shaft for rotation around the spindle. The adjusting mechanism further comprises a first bearing (7) for the roller shaft that defines a first end position for the connecting member (31). At least one of the bracket connectors (21) comprises a pin (33) for detachable mounting in (Continued)

a cooperating recess (35) on the adjusting mechanism, wherein the pin and the recess have an unround cross section.

7 Claims, 6 Drawing Sheets

(51) Int. Cl.

| | |
|---|---|
| ***E06B 9/50*** | (2006.01) |
| ***E06B 9/60*** | (2006.01) |
| *E06B 9/40* | (2006.01) |

(56) References Cited

U.S. PATENT DOCUMENTS

| | | | | |
|---|---|---|---|---|
| 9,334,688 | B2 * | 5/2016 | Colson | E06B 9/68 |
| 10,428,580 | B2 * | 10/2019 | Vries | E06B 9/42 |
| 10,704,324 | B2 * | 7/2020 | Goldberg | E06B 9/323 |
| 10,731,408 | B2 * | 8/2020 | Wei | E06B 9/34 |
| 2008/0190572 | A1 * | 8/2008 | Kwak | E06B 9/42 160/313 |
| 2010/0122780 | A1 * | 5/2010 | Cheng | E06B 9/60 160/305 |
| 2010/0212843 | A1 * | 8/2010 | Bohlen | E06B 9/88 160/168.1 R |
| 2011/0139380 | A1 * | 6/2011 | Anthony | E06B 9/56 160/293.1 |
| 2014/0069596 | A1 | 3/2014 | Ng | |
| 2014/0096920 | A1 * | 4/2014 | MacDonald | E06B 9/42 160/291 |
| 2015/0136337 | A1 * | 5/2015 | Fraczek | E06B 9/78 160/291 |
| 2015/0191973 | A1 * | 7/2015 | Bohlen | E06B 9/78 160/291 |
| 2015/0300085 | A1 * | 10/2015 | Klein Tuente | E06B 9/50 248/267 |
| 2015/0376941 | A1 * | 12/2015 | Fujita | E06B 9/60 160/241 |
| 2017/0067289 | A1 * | 3/2017 | Campagna | E06B 9/72 |
| 2017/0159359 | A1 * | 6/2017 | Vries | E06B 9/42 |
| 2017/0175440 | A1 | 6/2017 | Bohlen | |
| 2018/0106107 | A1 * | 4/2018 | Smith | E06B 9/42 |
| 2018/0155984 | A1 * | 6/2018 | Jay | E06B 9/88 |

FOREIGN PATENT DOCUMENTS

| | | | |
|---|---|---|---|
| EP | 2894289 | A1 | 7/2015 |
| EP | 2933428 | A1 | 10/2015 |
| NL | 2015678 | B1 | 5/2017 |

* cited by examiner

SPRING OPERATED ROLLER BLIND SYSTEM WITH END POSITION ADJUSTING MECHANISM

The present invention relates to a roller blind system, comprising a roller blind provided with a roller shaft through which roller shaft a central rod extends and to which roller shaft a flexible sheet member, such as a roller blind fabric or a screen, is attached, wherein the roller blind is further provided with two bracket connectors attached at the outer ends of the roller shaft, wherein the bracket connectors are arranged for releasable coupling to mounting brackets for mounting the roller blind system on a surface, wherein the roller blind is spring operated and comprises a tension spring fixedly connected to the central rod and to the roller shaft.

A roller blind system according to the preamble is known from the Dutch patent application NL2015678 (not pre published) of the same applicant. The known roller blind system has a tension adjusting mechanism that after mounting allows for optimal adjustment of the tension of the tension spring by the user to his or her specific needs. European patent application EP2933428 of the same applicant describes a chain operated roller blind system with the inventive bracket connectors that are easy to couple to the inventive mounting brackets in any situation.

The invention has for its object to provide a spring operated roller blind system that allows for easy releasable coupling of a spring operated roller blind to mounting brackets and for continuous optimal adjustment of the roller blind.

The roller blind system according to the invention is characterized in that the roller blind comprises an adjusting mechanism for adjusting the end position of the flexible sheet member, wherein the adjusting mechanism comprises a spindle and a connecting member that is connected to the roller shaft for rotation around the spindle, wherein the adjusting mechanism further comprises a first bearing for the roller shaft that defines a first end position for the connecting member, wherein the bracket connector comprises a pin for detachable mounting in a cooperating recess on the adjusting mechanism, wherein the pin and the recess have an unround cross section.

According to the invention the adjusting mechanism is integrated in the roller blind not in the separate mounting brackets. Consequently, the roller blind system is suitable for mounting in the window frame. The roller blind system according to the invention allows for easy releasable mounting of a spring operated roller blind in mounting brackets without requiring a mounting profile extending between the mounting brackets. Advantageously the pin allows for some tolerance in the position of the mounting brackets. After mounting the roller blind the adjusting mechanism allows for optimal adjustment of the end position of the flexible sheet member by the user to his or her specific needs. Consequently, the present invention provides a spring operated roller blind system that is suitable for the DIY market.

According to a first preferred embodiment the pin and the recess have a polygonal, preferably a hexagonal, cross-section. Advantageously the first embodiment allows for a stepwise adjustment of the end position of the flexible sheet member. The adjustment can take place after decoupling the adjustment mechanism of the roller blind from the bracket connector. The step size of the adjustment depends on the shape of the polygonal and is sixty degrees in the first preferred embodiment.

According to a further preferred embodiment the adjusting mechanism further comprises a second bearing for the roller shaft that is attached to the spindle and defines a second end position for the connecting member. In this further preferred embodiment the pathway for the connecting member is defined between the first and the second end position.

According to a second preferred embodiment the adjusting mechanism further comprises an adjusting wheel connected to the spindle for adjusting the position of the connecting member on the spindle by rotating the spindle relative to the connecting member. Advantageously the adjusting mechanism in the second preferred embodiment allows for step less adjustment of the end position of the flexible sheet member by rotating the wheel. During the adjustment the roller blind can remain coupled in the mounting brackets.

In a practical compact embodiment the adjusting mechanism further comprises a bush onto which the adjusting wheel is arranged co-axially, wherein an outer end of the bush is provided with the recess for mounting the pin. The coaxial arrangement of the various parts makes the adjusting mechanism very compact thus avoiding the occurrence of any light gap between the flexible sheet member or roller curtain and the window frame.

In an elegant compact embodiment the adjusting mechanism further comprises at least one adjusting spring arranged co-axially on the bush.

According to a further elegant compact embodiment the adjusting mechanism further comprises first engaging means for pushing the adjusting spring in a relaxed configuration and second engaging means for pushing the adjusting spring in a tightened configuration, wherein the first engaging means are arranged on the adjusting wheel and the second engaging means are connected to the spindle.

Preferably the first engaging means comprise a first bush part and the second engaging means comprise a second bush part and the adjusting spring is enclosed by the bush, the first bush part and the second bush part. These technical measures support achievement of the envisaged compactness.

According to a user friendly embodiment of the roller blind system according to the invention the adjusting wheel is arranged for manual operation.

According to a complete embodiment the roller blind system according to the invention further comprises the mounting brackets for mounting the roller blind system on a surface.

The invention will now be described in more detail with reference to the figures, in which FIG. 1 shows a schematic view of a first preferred embodiment of a roller blind system according to the invention;

Figure 1:
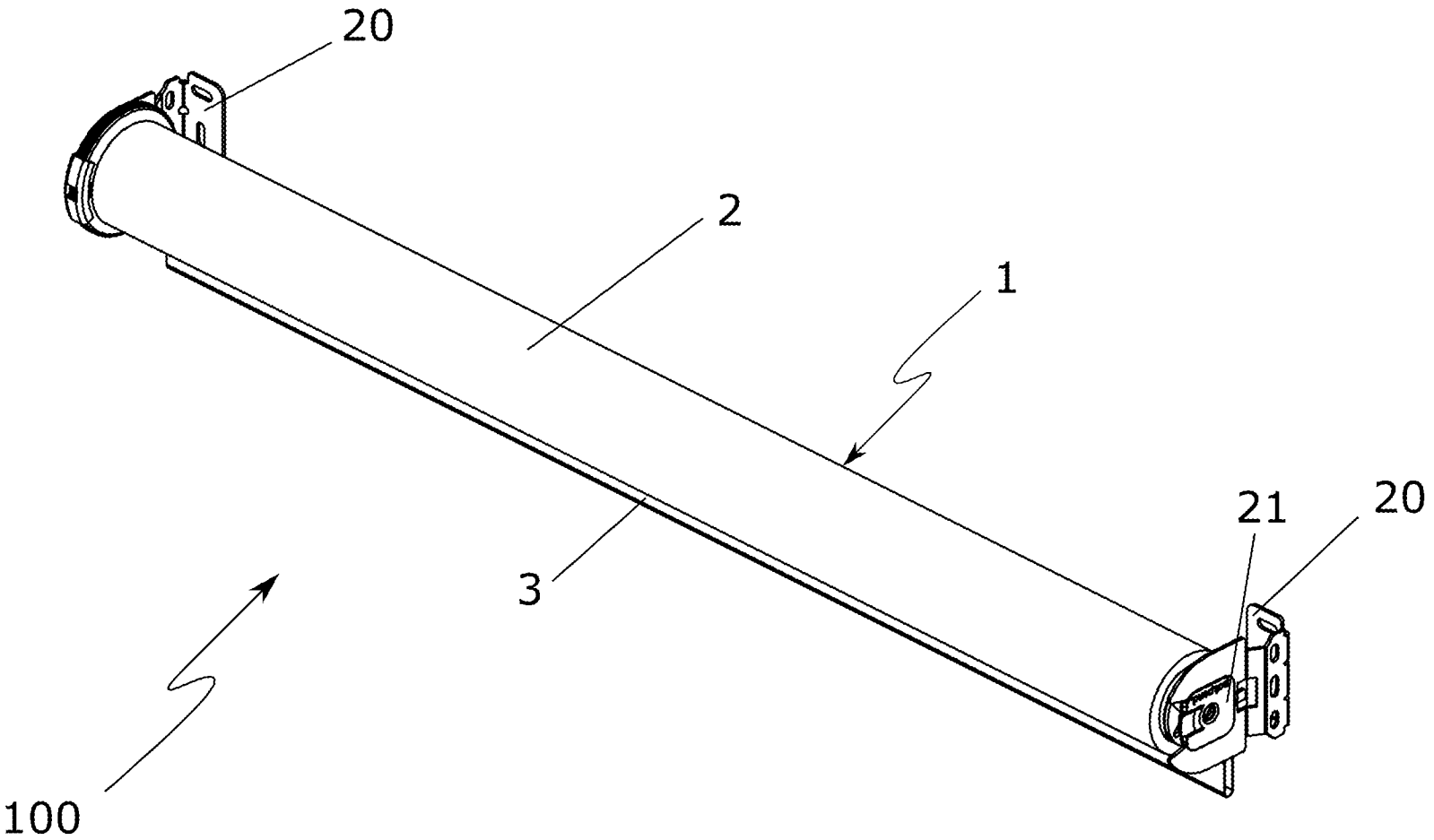
Figure 3:
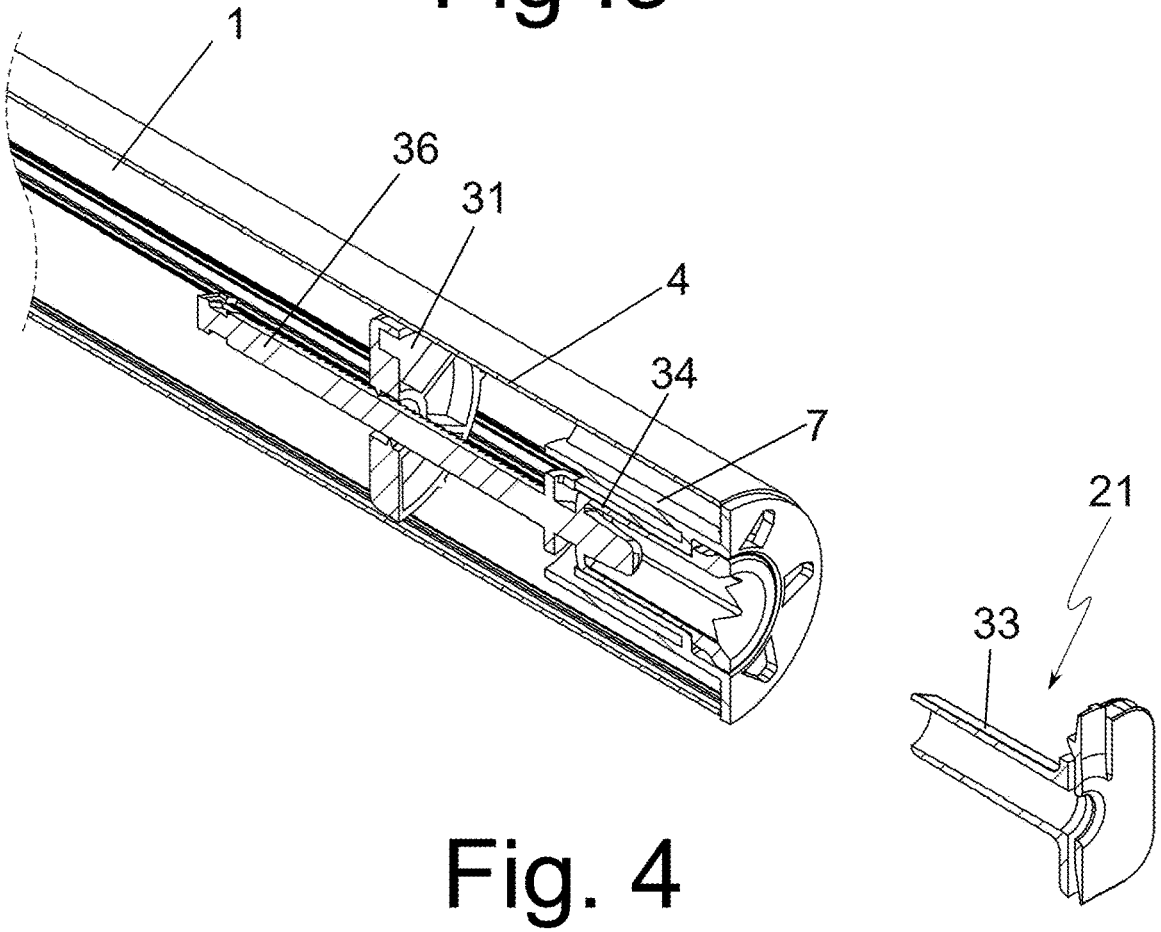
Figure 4:
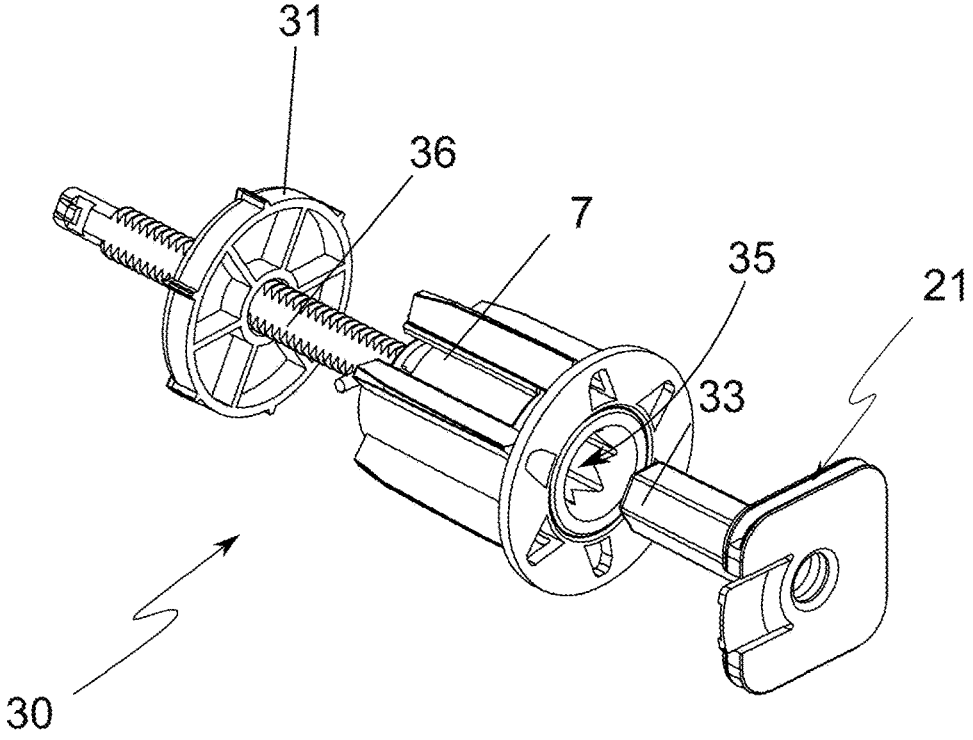
Figure 5A:
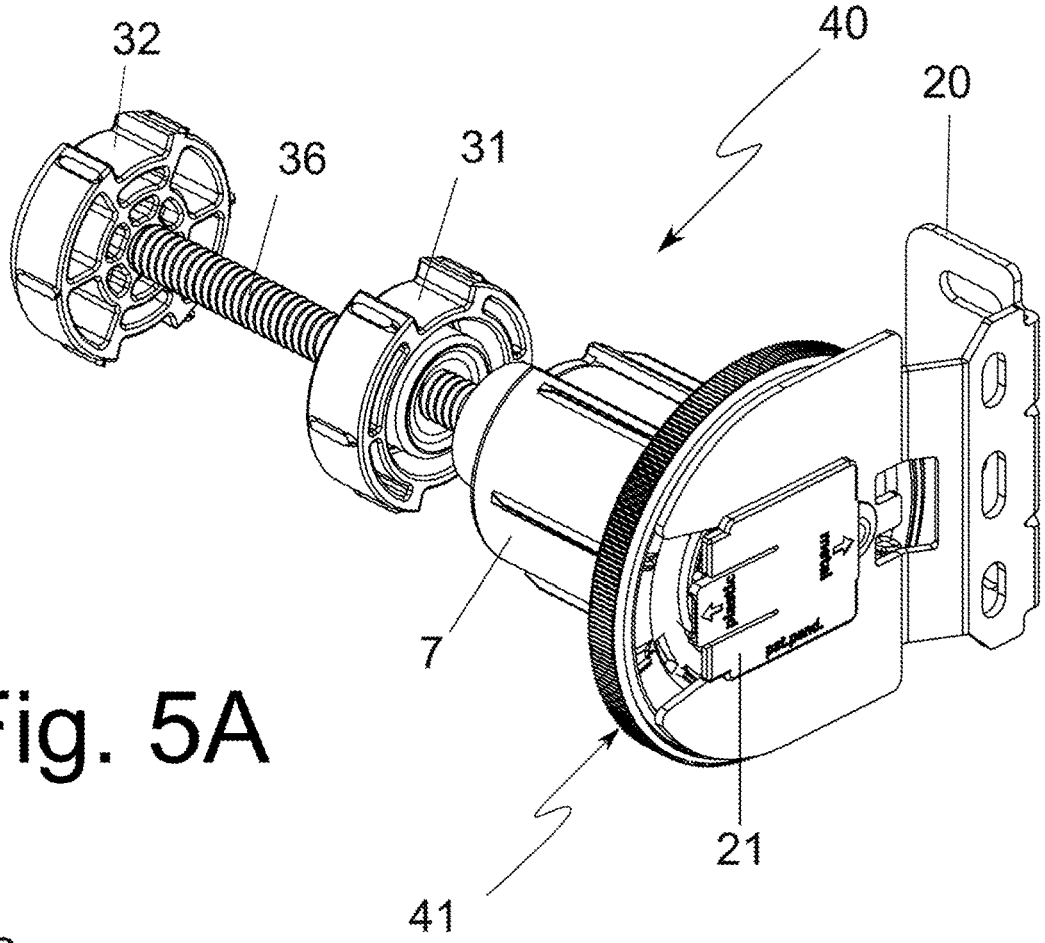
Figure 5B:
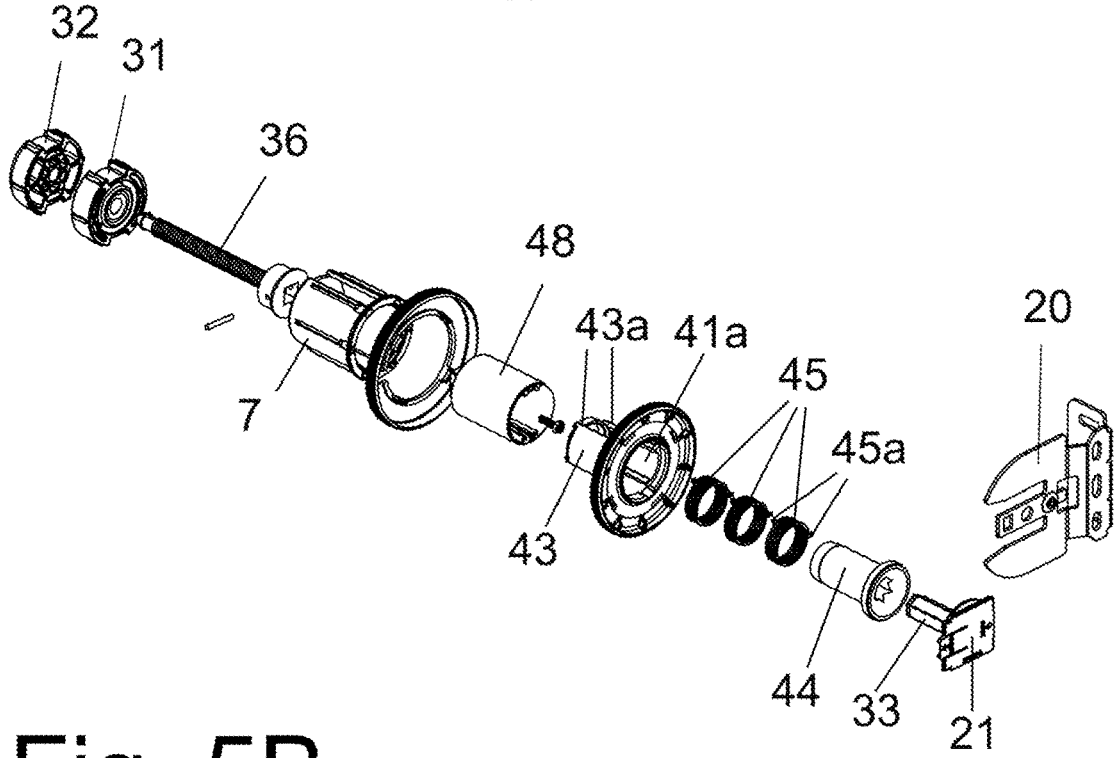
Figure 6:
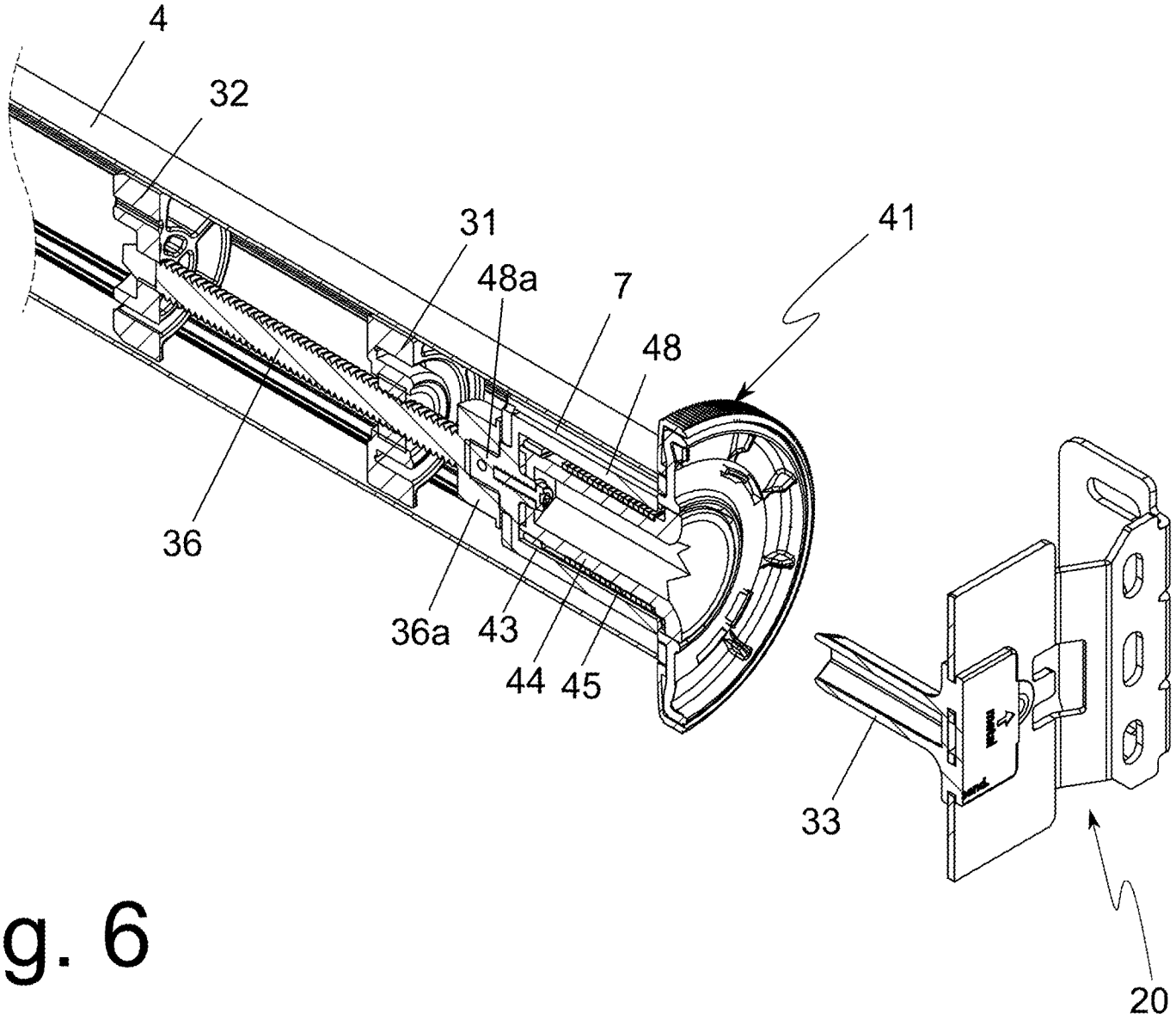

FIG. 3 schematically shows the first embodiment of FIG. 1 in assembled state in cross section;

FIG. 4 schematically shows an enlarged view of the first embodiment of FIG. 2 in assembled state;

FIG. 5A schematically shows an enlarged view of a second embodiment of the adjusting mechanism as part of the roller blind system of FIG. 1 in assembled state;

FIG. 5B schematically shows a second embodiment of an adjusting mechanism in exploded view; and FIG. 6 schematically shows the second embodiment of FIGS. 5A and 5B in assembled state in cross section.

The same components are designated in the different figures with the same reference numerals.

Figure 2A:
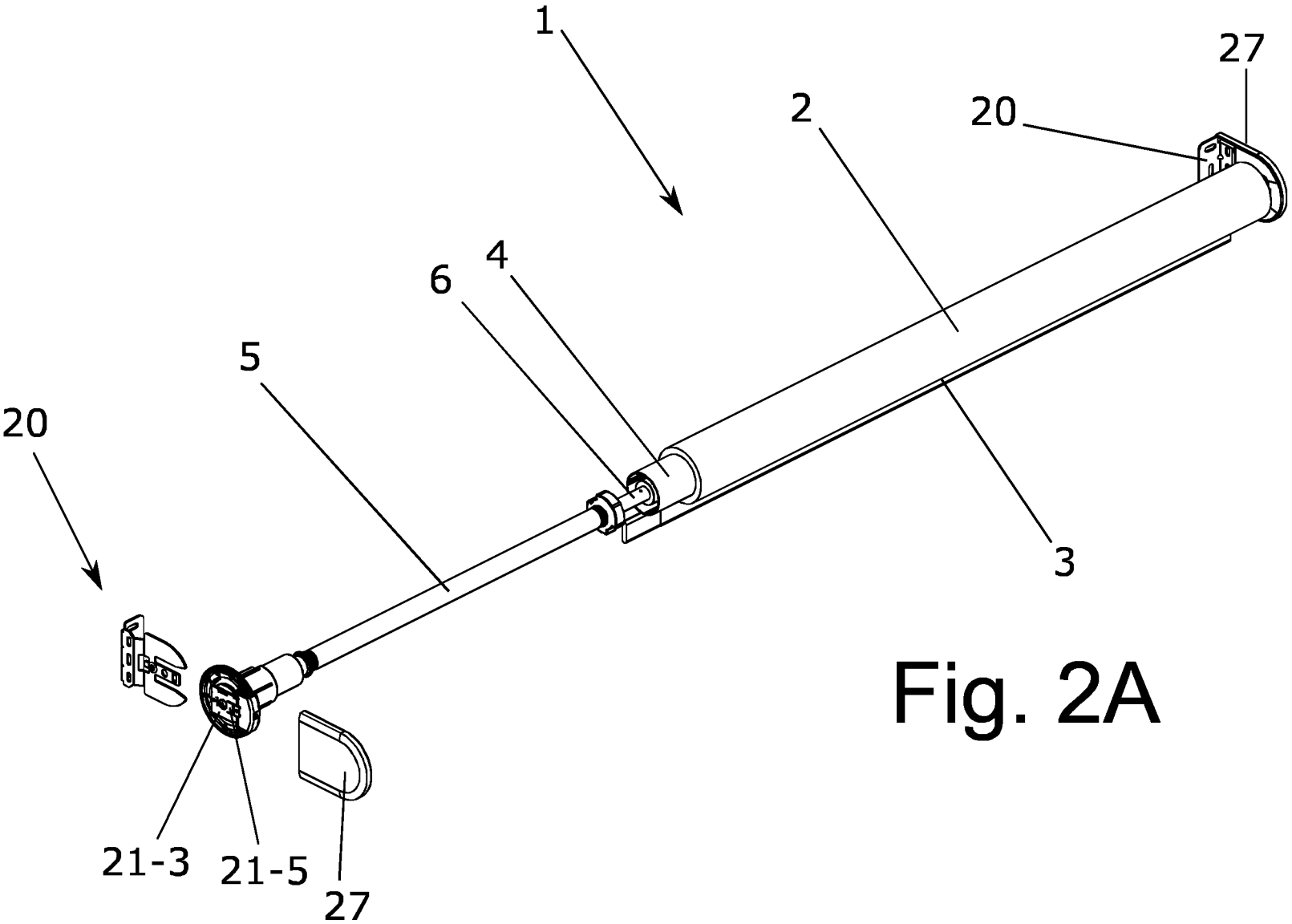
FIG. 2A shows a schematic view of part of the roller blind system of FIG. 1 with exploded parts.
Figure 2B:
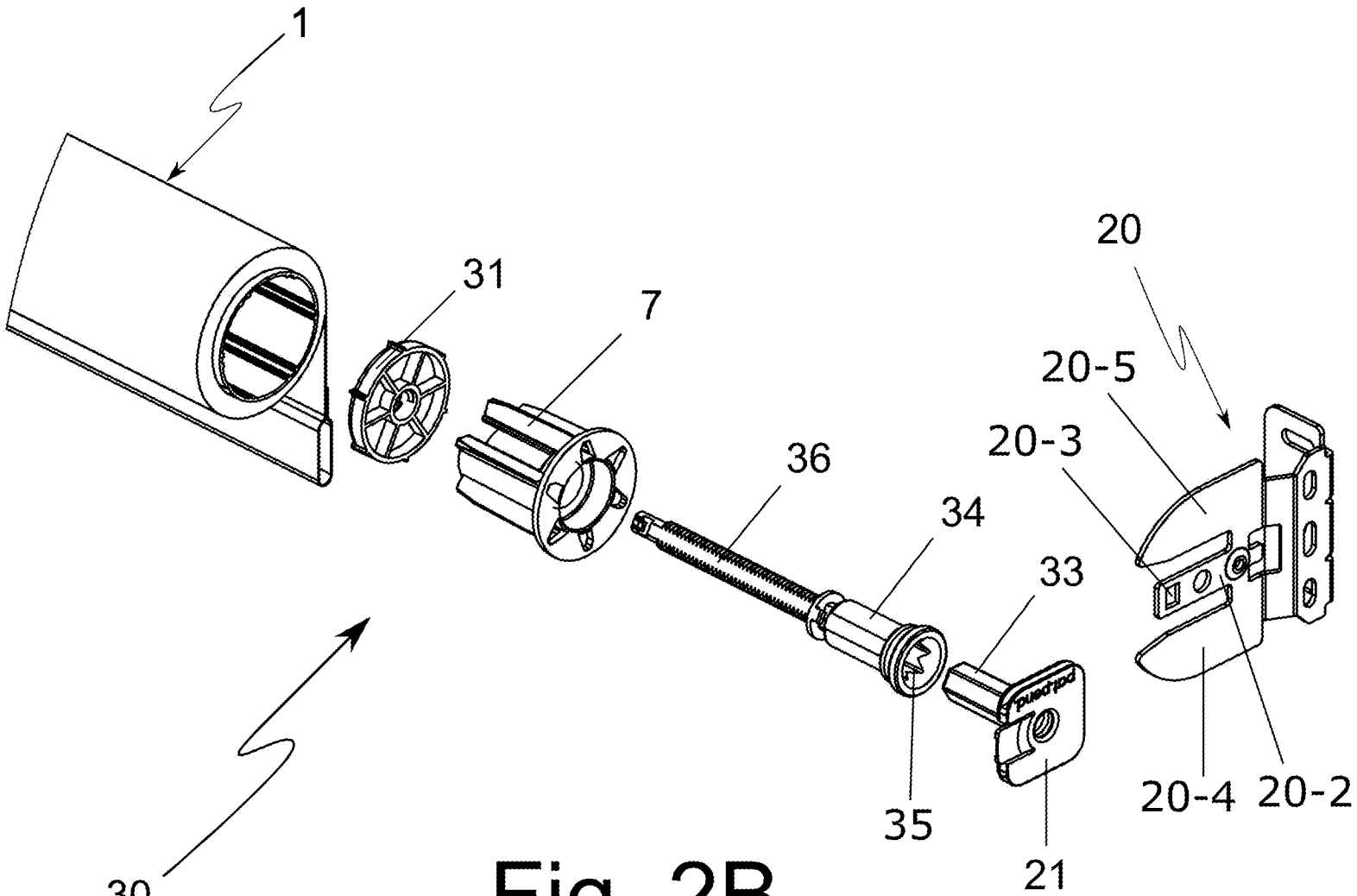
FIG. 2B shows a schematic view of a first embodiment of an adjusting mechanism as part of the roller blind system of FIG. 1 with exploded parts.

FIG. 1 shows a schematic view of a first preferred embodiment of a roller blind system according to the invention. FIGS. 2A and 2B show the roller blind system of FIG. 1 with exploded parts. FIGS. 3 and 4 show more details of the first preferred embodiment.

The roller blind system 100 comprises a roller blind 1 provided with a roller shaft 4 through which roller shaft a central rod 6 extends and to which roller shaft a flexible sheet member or roller curtain 2 is attached in a conventional manner. The roller blind 1 is cordless and operable by handling a bottom bar 3 attached to the roller curtain 2. Two bracket connectors 21 are attached at the outer ends of the roller blind 1. The bracket connectors 21 are arranged for releasable attachment to mounting brackets 20 for mounting the roller blind system on a surface. Optionally end caps 27 are mounted over the mounting brackets 20 in the mounted state of the roller blind 1.

Suitable devices for mounting a shaft of a screen such as a window covering, on a surface, such as a wall, window frame or a ceiling, having releasably attachable mounting brackets and bracket connectors or shaft holders are known in the relevant field. Particularly suitable is a device of the same applicant that is described in the abovementioned European patent application EP2933428, incorporated herein by reference. The known mounting brackets and bracket connectors are shown in the figures and will now be briefly described. Shaft holder or bracket connector 21 is provided with a connecting piece or pin for connection to the shaft of the roller blind 1. Mounting bracket 20 is provided with one locking tooth 20-2 and bracket connector 21 is provided with a corresponding slot which is configured to receive locking tooth 20-2. Because an end plate 21-3 is arranged at a distance from bracket connector 21 using two spacers on bracket connector 21, the space between the two spacers here forms the slot. Bracket connector 21 is provided with a controllable hook arranged on a tongue 21-5 on end plate 21-3. The hook is however not visible in the perspective of this figure. Locking tooth 20-2 is provided with a hole 20-3. When locking tooth 20-2 is placed in the slot, the hook will drop into hole 20-3 and bracket connector 21 will be locked to mounting bracket 20. Bracket connector 21 can be unlocked from mounting bracket 20 again by operating the tongue 21-5.

Mounting bracket 20 is also provided with guide teeth 20-4 and 20-5 which engage on both sides of the spacers. Guide teeth 20-4 and 20-5 guide bracket connector 21 in mounting bracket 20. Locking tooth 20-2 and guide teeth 20-4 and 20-5 together form a fork.

A tension spring is fixedly connected to the central rod 6 and the roller shaft 4. The tension spring 5 is schematically shown in the figures. An example of a suitable tension spring and a tension adjusting mechanism for adjusting the tension of the tension spring is described in the Dutch patent application NL2015678 (not pre published) of the same applicant.

According to the invention the roller blind comprises an adjusting mechanism 30 for adjusting the upper end position of the flexible sheet member 2. The adjusting mechanism 30 comprises a spindle 36 and a connecting member 31 that is fixedly connected to the roller shaft 4 for simultaneous rotation around the spindle 36. Preferably the connecting member 31 is a nut having coupling means around its circumference to connect to the inner surface of the roller shaft 4. Preferably the inner surface of the roller shaft 4 is provided with a coupling profile to connect to said coupling means, for instance cams.

The adjusting mechanism 30 further comprises a first bearing 7 for the roller shaft 4 that is attached at one end of the spindle 36 and faces the bracket connector 21. The first bearing (or end plug) 7 defines a first end position for the connecting member 31. The first bearing 7 is arranged on a bush 34 connected to the spindle 36 at one end and being provided with a recess 35 on the other end. The bracket connector 21 comprises a pin or shaft 33 to be mounted in said recess 35 on the adjusting mechanism. Both the pin 33 and the recess 35 have a polygonal cross section, preferably a hexagonal cross section. The first embodiment of the adjusting mechanism 30 allows for step wise adjustment of the upper end position of the flexible sheet member 2. Adjustment takes places by decoupling the bracket connector 21 from the adjusting mechanism 30 of the roller blind 1, rotating the roller blind and coupling it to the bracket connector 21. The step size depends on the shape of the polygonal and is 60 degrees in the first embodiment.

FIGS. 5 and 6 show details of a second preferred embodiment of the roller blind system according to the invention. The same reference numerals are denoted with the same reference numerals.

In a second embodiment the adjusting mechanism 40 comprises an adjusting wheel 41 indirectly connected to the spindle 36 for adjusting the position of the connecting member 31 on the spindle 36 by rotating the spindle 36 relative to the connecting member 31. Preferably the adjusting mechanism 40 further comprises a second bearing 32 for the profiled roller shaft 4 that is attached to the spindle 36 and defines a second end position for the connecting member.

The adjusting mechanism 40 allows for step less adjustment of the upper end position of the flexible sheet member 2 by rotating the wheel 41. During adjustment the adjusting mechanism 40 of the roller blind 1 can remain coupled to the bracket connector 21.

According to the invention the adjusting mechanism 40 comprises at least one adjusting spring 45, first engaging means 43 arranged on the adjusting wheel 41 and acting on the adjusting spring 45 and second engaging means 48 for engaging the adjusting spring 45 that are arranged at one outer end of the spindle 36. Preferably a number of adjusting springs 45 are arranged in series and the first engaging means 43 are arranged for pushing the series of adjusting springs in a relaxed configuration and the second engaging means 48 are arranged for pushing the series of adjusting springs in a tightened configuration. In the second embodiment shown the number of adjusting springs 45 is three. Naturally this number can be varied depending on the force needed in the adjusting mechanism 40.

Each adjusting spring 45 has a substantially prismatic shape, i.e. substantially the same cross section over its entire length. The adjusting spring 45 terminates in tangs 45*a*. The wheel 41 has a central opening 41*a*. In accordance with the invention the adjusting wheel 41 and the adjusting springs 45 are arranged coaxially on an intermediate bush 44 having a recess for receiving the polygonal pin 33 of the bracket connector 21. The wheel 41 is designed for manual operation and is preferable provided with a crenated edge 42.

According to the present invention the first engaging means comprise a first bush part 43 extending around the central opening 41*a* in the wheel 41. The first bush part 43 is shaped as a cylinder with cut away parts and has a diameter larger than the diameter of the adjusting spring 45 that can be partly received in the first bush part 43. The first bush part 43 is provided with outer edges 43*a* for engaging the tangs 45*a* of the adjusting spring 45.

The second engaging means comprise a second bush part 48. The second bush part 48 is provided with a connector element 48*a* for connection to a connector element 36*a* arranged on the spindle 36. The second bush part 48 is further arranged for connection to the wheel 41. The second bush part 48 is shaped as a cylinder. The diameter of the second bush part 48 is larger than the diameter of the first bush part 43. The second bush part 48 has inner ribs engaging on the tangs 45*a* of the adjusting springs from an opposite side as do the edges 43*a* of the first bush part 43.

In the assembled state the adjusting springs 45 are enclosed in the space between the bush 44 and the first bush part 43 and the second bush part 48. The space for the adjusting springs 45 is large enough to allow to house the adjusting springs 45 in two configurations: a relaxed configuration and a tightened or strangled configuration.

The first bush part 43 engages the adjusting springs 45 from the outside pushing the adjusting springs 45 in a first relaxed or loose configuration. In the relaxed or loose configuration of the adjusting springs 45, the adjusting springs 45 touch the surface of bush 44 only loosely (if at all), and therefore the wheel 41 can be manually operated to rotate the spindle 36 in a clockwise respectively counter clockwise direction to change the upper end position of the flexible member 2.

The second bush part 48 engages the adjusting springs 45 from the inside pushing the adjusting springs 45 in the second tightened or strangled configuration. In the tightened or strangled configuration the adjusting springs frictionally engage the outer surface of the bush 44. In this configuration the bracket connector 21 and the spindle 36 are interlocked.

Consequently the flexible member 2 will remain its position as adjusted by the adjusting mechanism 40.

The invention follows from the inventive thought to integrate an adjusting mechanism for an end position of a roller curtain of a roller blind in the roller blind and to design the adjusting mechanism for detachable coupling to an unround pin of a bracket connector that may be mounted in advance in a mounting bracket.

The invention is of course not limited to the described and shown preferred embodiment but extends to any embodiment falling within the scope of protection as defined in the claims and as seen in the light of the foregoing description and accompanying drawings.

The invention claimed is:

1. A roller blind system, comprising a roller blind provided with a roller shaft, a central rod that extends through the roller shaft and a flexible sheet member that is attached to the roller shaft, wherein the roller blind system is further provided with two bracket connectors for attachment at opposing outer ends of the roller blind, wherein the bracket connectors are arranged for releasable coupling to mounting brackets for mounting the roller blind system on a surface, wherein the roller blind is spring operated and comprises a tension spring fixedly connected to the central rod and to the roller shaft, wherein the roller blind comprises an adjusting mechanism for adjusting an end position of the flexible sheet member, wherein the adjusting mechanism comprises a spindle and a connecting member that is connected to the roller shaft for rotation around the spindle, wherein the adjusting mechanism further comprises a first bearing for the roller shaft that defines a first end position for the connecting member, wherein at least one of the bracket connectors comprises a pin and the adjusting mechanism comprises a bush, wherein an outer end of the bush is provided with a recess for mounting the pin, wherein the pin is detachably mountable in the recess, wherein the pin and the recess have an unround cross section, wherein the adjusting mechanism further comprises an adjusting wheel connected to the spindle for adjusting the position of the connecting member on the spindle by rotating the spindle relative to the connecting member, wherein the adjusting wheel is arranged coaxially on the bush, wherein the adjusting mechanism further comprises at least one adjusting spring arranged coaxially on the bush, and wherein the adjusting mechanism further comprises first engaging means for pushing the adjusting spring in a relaxed configuration and second engaging means for pushing the adjusting spring in a tightened configuration, wherein the first engaging means are arranged on the adjusting wheel and the second engaging means are connected to the spindle.

2. The roller blind system according to claim 1, wherein the pin and the recess have a polygonal cross section.

3. The roller blind system according to claim 1, wherein the adjusting mechanism further comprises a second bearing for the roller shaft that is attached to the spindle and defines a second end position for the connecting member.

4. The roller blind system according to claim 1, wherein the first engaging means comprise a first bush part and wherein the second engaging means comprise a second bush part and the adjusting spring is enclosed by the bush, the first bush part and the second bush part.

5. The roller blind system according to claim 1, wherein the adjusting wheel is manually operable.

6. The roller blind system according to claim 1, further comprising the mounting brackets for mounting the roller blind system on a surface.

7. The roller blind system according to claim 1, wherein the pin and the recess have a hexagonal cross section.

* * * * *